US011459639B2

(12) United States Patent
Kidder et al.

(10) Patent No.: US 11,459,639 B2
(45) **Date of Patent: *Oct. 4, 2022**

(54) POWDER METALLURGY PROCESS FOR MAKING LEAD FREE BRASS ALLOYS

(71) Applicant: Mueller Industries, Inc., Memphis, TN (US)

(72) Inventors: Christopher Todd Kidder, Germantown, TN (US); Barry George Munce, Lexington, MI (US); Steffen Sigloch, Memphis, TN (US)

(73) Assignee: Mueller Industries, Inc., Memphis, TN (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/750,851

(22) Filed: Jan. 23, 2020

(65) Prior Publication Data

US 2020/0157656 A1 May 21, 2020

Related U.S. Application Data

(63) Continuation-in-part of application No. 16/351,114, filed on Mar. 12, 2019.

(Continued)

(51) Int. Cl.

*C22C 1/04* (2006.01)
*B22F 3/10* (2006.01)

(Continued)

(52) U.S. Cl.

CPC ..... *C22C 1/0425* (2013.01); *B22F 1/145* (2022.01); *B22F 3/1021* (2013.01); *B22F 9/082* (2013.01);

(Continued)

(58) Field of Classification Search

None

See application file for complete search history.

(56) References Cited

U.S. PATENT DOCUMENTS 3,476,548 A * 11/1969 Cloran ..... B22F 1/0088 75/345
4,064,914 A * 12/1977 Grant ..... C23C 24/106 138/142

(Continued)

FOREIGN PATENT DOCUMENTS

CN 101235448 A 8/2008
CN 102477496 * 5/2012

(Continued)

OTHER PUBLICATIONS

Imai, Hisashi, et al. "Development of lead-free machinable brass with bismuth and graphite particles by powder metallurgy process." Materials transactions 51.5 (2010): 855-859. (Year: 2010).*

(Continued)

*Primary Examiner* — Nicholas A Wang

(74) *Attorney, Agent, or Firm* — Harness, Dickey & Pierce, P.L.C.

(57) ABSTRACT

Graphite-containing brass alloy billets having less than 0.25 wt. % lead and a method of manufacturing relating thereto are provided. The method includes forming a brass powder and mixing the brass powder with graphite and one or more binders. The brass powder contains copper and zinc and may be formed using water atomization. The brass-powder mixture is compacted to form an initial billet. The initial billet may be subjected to one or more heating treatments. A first heating treatment may be used to remove the one or more binders. An optional second heating treatment may be used to deoxidize the binder-free billet. An optional third heating treatment that includes applying a pressure may be used to (Continued)

Figure 1:
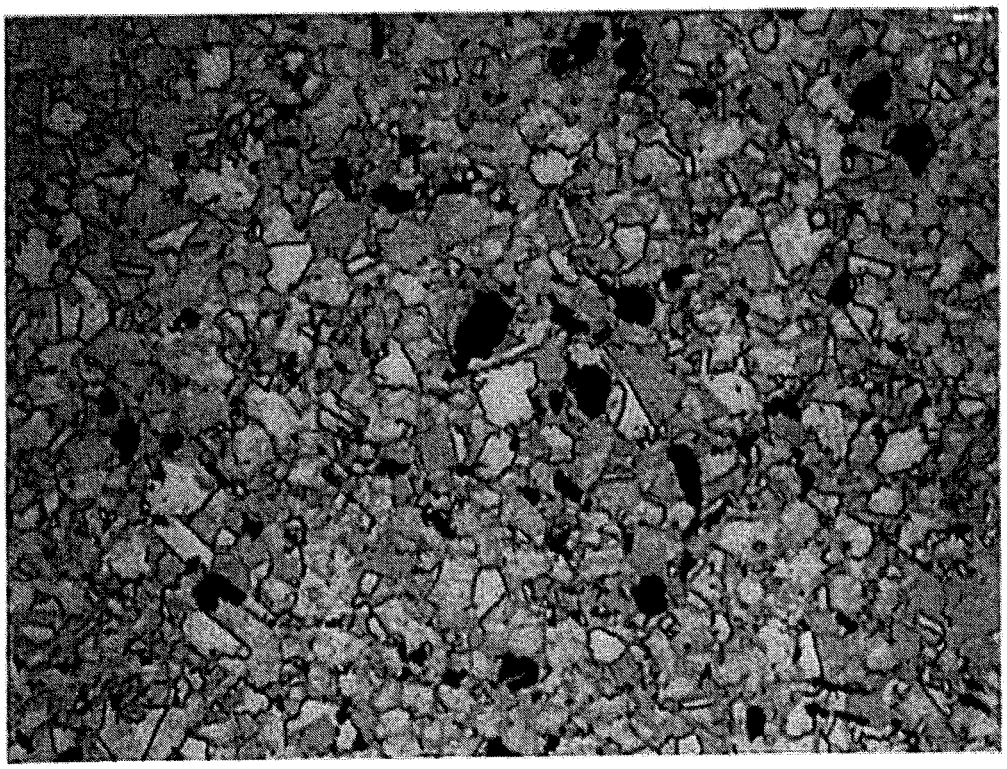

densify the binder-free billet. A third heating treatment may sinter the compact to form the workable graphite-containing brass alloy billet.

19 Claims, 2 Drawing Sheets

Related U.S. Application Data

(60) Provisional application No. 62/642,380, filed on Mar. 13, 2018.

(51) Int. Cl.

| | |
|---|---|
| ***C22C 1/05*** | (2006.01) |
| ***C22C 9/04*** | (2006.01) |
| ***B22F 9/08*** | (2006.01) |
| ***B22F 1/145*** | (2022.01) |

(52) U.S. Cl.

CPC ..... *C22C 1/05* (2013.01); *C22C 9/04* (2013.01); *B22F 2009/0828* (2013.01); *B22F 2301/10* (2013.01)

(56) References Cited

U.S. PATENT DOCUMENTS

| | | | | |
|---|---|---|---|---|
| 4,207,096 | A | 6/1980 | Suwa et al. | |
| 5,556,446 | A | 9/1996 | Matthews et al. | |
| 5,637,132 | A | 6/1997 | Matthews et al. | |
| 5,993,731 | A * | 11/1999 | Jech | B22F 3/23 419/19 |
| 6,280,683 | B1 * | 8/2001 | Hendrickson | B22F 1/0077 419/37 |
| 2011/0056591 | A1 | 3/2011 | Kondoh et al. | |
| 2013/0294965 | A1 | 11/2013 | Sahoo et al. | |
| 2016/0130685 | A1 * | 5/2016 | Huang | B22F 3/12 419/10 |
| 2018/0355459 | A1 * | 12/2018 | Huang | C22C 1/0425 |
| 2019/0283132 | A1 | 9/2019 | Munce et al. | |
| 2020/0157656 | A1 | 5/2020 | Kidder et al. | |

FOREIGN PATENT DOCUMENTS

| | | | |
|---|---|---|---|
| CN | 106435256 | A | 2/2017 |
| EM | 0569419 | B1 | 11/1997 |
| IT | SB20130119 | A1 | 2/2015 |
| JP | H09143591 | A | 6/1997 |
| WO | WO-2017199147 | A1 | 11/2017 |

OTHER PUBLICATIONS

C.M. Cotell, ASM Handbook, vol. 5: Surface Engineering, Acid Cleaning, 1994 (Year: 1994).*

Daye, ASM Handbook, vol. 7: Powder Metallurgy, Processing of Powder Metallurgy Bronze and Brass, 2015 (Year: 2015).*

Samal, ASM Handbook, vol. 7: Powder Metallurgy, Production of Copper and Copper alloy Powders, 2015 (Year: 2015).*

Mashl, ASM Handbook, vol. 7: Powder Metallurgy, Powder Metallurgy Processing by Hot Isostatic Pressing, 2015 (Year: 2015).*

Kondoh, Katsuyoshi, et al. "Machinable Cu-40% Zn composites containing graphite particles by powder metallurgy process." Journal of Metallurgy 2009 (2009). (Year: 2009).*

Morris, K.J. Cold isostatic pressing. 1991. p. 84-88 (Year: 1991).*

Bocanegra-Bernal, M.H. et al. "Review hot isostatic pressing HIP technology and its applications to metals and ceramics" 2004. Journal of materials science. 39. p. 6399-6420. (Year: 2004).*

Kumar, A. et al. "Effects of hot isostatic pressing on copper parts fabricated via binder jetting". 2017. Procedia manufacturing. 2017. p. 935-944. (Year: 2017).*

International Search Report and Written Opinion of The International Searching Authority for corresponding International Application PCT/US2019/022081 dated Jul. 2, 2019.

The International Search Report and Written Opinion of the International Searching Authority in International Application No. PCT/US2020/064767 dated Mar. 9, 2021.

Third Party Observation for International Application No. PCT/US2019/022081 dated Jan. 29, 2020 (53 pages).

Extended European Search Report for corresponding European patent application No. 19766535.9 dated Nov. 2, 2021, 11 pages.

* cited by examiner

POWDER METALLURGY PROCESS FOR MAKING LEAD FREE BRASS ALLOYS

CROSS-REFERENCE TO RELATED APPLICATIONS

This application is a continuation in part of U.S. patent application Ser. No. 16/351,114, filed on Mar. 12, 2019, which claims the benefit of U.S. Provisional Application No. 62/642,380 filed on Mar. 13, 2018. The entire disclosure of each of the above applications is incorporated herein by reference.

FIELD

This present disclosure relates to substantially lead free brass alloy billets and methods of manufacturing relating thereto.

BACKGROUND

This section provides background information related to the present disclosure which is not necessarily prior art.

For several decades, free-machining leaded-brass rods—for example, alloy C36000—have been the dominant alloy bar stock in North America. This material is commonly manufactured by casting a billet that is subsequently hot extruded into a brass rod. The combination of excellent machinability, corrosion resistance, mechanical properties, and economics have made such leaded-brass alloy bar stocks a material of choice for many design engineers. For example, because lead is insoluble in brass, lead collects at grain boundaries and presents as a discrete constituent. In this fashion, the lead may function as an effective chip breaker during machining, thereby improving the machinability of the leaded-brass rods. Further, lead may serve as a lubricant during machining operations by coating a cutting edge of the machining tool so to lower friction levels and minimize heat generation. Reducing heat emissions may increase the lifespan of the machining tool and improve its surface finish, and also allows for the use of greater machining speeds so to reduce machining cycle times.

While the presence of lead may improve the machinability of the brass rods, there is presently a vigorous movement to eliminate or minimize the presence of lead in potable water applications because of the potential risks for water contamination and related health concerns. Current U.S. federal legislation requires that brass components and/or brass assemblies that have a possibility of coming in contact with potable water have an average lead content not exceeding 0.25 wt. %. Currently, free-machining leaded-brass rods—for example, alloy C36000—have an average lead content of about 2.5 wt. % to about 3.0 wt. %, which well exceeds the maximum defined by regulatory standards.

Concurrent to the regulatory push to reduce and/or eliminate lead in brass rods is an industry push to further improve corrosion resistance in yellow-brass alloys, in particular, with regard to dezincification and stress corrosion cracking. Yellow-brass alloys having an alpha structure and using an inhibitor—for example, arsenic, antimony, and/or phosphorus—are generally resistant to dezincification. All yellow-brass alloys comprising less than about 35 wt. % of zinc have an alpha structure. However, as the zinc content decreases the necessary copper content increases, which causes the costs of the alloy to increase. Moreover, yellow-brass alloys comprising greater than about 35 wt. % of zinc often require post-hot work thermal treatment to minimize dezincification. This additional processing step increases manufacturing times and, therefore, it also increases the cost of the alloy. Stress corrosion cracking is commonly minimized using a post-cold work stress-relieving annealing process. However, this additional processing step also increases manufacturing times and the cost of the yellow-brass alloy.

Accordingly, there is a need for economical brass alloys having lead contents that meet current and future regulatory requirements, and also, a machinability that is comparable to current lead containing alloys and have improved corrosion resistance.

SUMMARY

This section provides a general summary of the disclosure, and is not a comprehensive disclosure of its full scope or all of its features.

In various aspects, the present disclosure provides a method for producing workable graphite-containing brass alloy billets having less than 0.25 wt. % of lead. The method includes forming a brass powder comprising copper and zinc; mixing the brass powder with graphite and one or more binders; compacting the brass-powder mixture to form an initial billet; heating the initial billet to a first elevated temperature to remove the one or more binders; heating the binder-free billet to a second elevated temperature that is higher than the first elevated temperature to densify the binder-free billet, where heating the binder-free billet to the second elevated temperature includes applying a pressure; and heating the densified billet to a third elevated temperature that is higher than the first elevated temperature to sinter the densified billet and form the workable graphite-containing brass alloy billets.

In one aspect, the method further includes, prior to the mixing of the brass powder with the graphite and the one or more binders, heating the brass powder to a reducing temperature greater than or equal to about 650° C. to less than or equal to about 900° C. in a reducing atmosphere.

In one aspect, the method further includes, prior to the mixing of the brass powder with the graphite and the one or more binders, deoxidizing the brass powder by mixing the brass powder with an acid solution comprising greater than or equal to about 0.5 wt. % to less than or equal to about 20 wt. % of one or more acids and rinsing the brass powder with water until the pH of the brass powder exceeds 6.5. The one or more acids may be selected from sulfuric acid, hydrochloric acid, nitric acid, and phosphoric acid.

In one aspect, the brass powder may be formed by water atomization.

In one aspect, the initial billet comprises a cylinder having a diameter of greater than or equal to about 127 mm (i.e., about 5 inches) to less than or equal to about 381 mm (i.e., about 15 inches) and a length greater than or equal to about 25.4 mm (i.e., about 1 inch).

In one aspect, the initial billet includes greater than or equal to about 55 wt. % to less than or equal to about 65 wt. % copper; greater than or equal to about 0.1 wt. % to less than or equal to about 2.0 wt. % graphite; and, a balance of zinc.

In one aspect, the initial billet further includes greater than or equal to about 0.02 wt. % to less than or equal to about 0.8 wt. % of one or more inhibitors. The one or more inhibitors may be selected from the group consisting of: arsenic, phosphorus, antimony, and combinations thereof.

In one aspect, the one or more binders may be selected from the group consisting of: alkanes ($C_nH_{2n+2}$, where n≥10), squalene, mineral spirits, kerosene, isoparaffinic fluids, and polyethers.

In one aspect, compacting comprises one of cold isostatic pressing ("CIP") and uniaxial pressing.

In one aspect, compacting comprises pressing the brass-powder mixture to a minimum density of about 60% of a theoretical density. The theoretical density is the density of a solid-metal billet having no voids and is a function of the percent composition of each element and the respective densities of the alloying components.

In one aspect, the first elevated temperature may be greater than or equal to about 200° C. to less than or equal to about 300° C.; the second elevated temperature is greater than or equal to about 480° C. to less than or equal to about 750° C.; and the third elevated temperature may be greater than or equal to about 650° C. to less than or equal to about 900° C.

In one aspect, the densified billet has a minimum density of about 93% of a theoretical density.

In various other aspects, the present disclosure provides a method for producing a workable graphite-containing brass alloy billet having less than 0.25 wt. % lead. The method includes mixing a brass powder comprising copper and zinc with an acid solution comprising, for example, one or more of sulfuric acid, hydrochloric acid, nitric acid, and phosphoric acid, and rinsing the brass powder with water until the pH of the solution exceeds 6.5. The method may further include drying the brass powder. The dried brass powder may be mixed with greater than or equal to about 0.05 wt. % to less than or equal to about 2.0 wt. % of a graphite powder and greater than or equal to about 0.02 wt. % to less than or equal to about 1 wt. % of one or more organic binders to form a brass-powder mixture. The brass-powder mixture may be compacted to form an initial billet. The initial billet may be heated to a first temperature greater than or equal to about 100° C. to less than or equal to about 400° C. to remove the binder. The binder-free billet may be heated to a second temperature greater than or equal to about 480° C. to less than or equal to about 750° C. to densify the binder-free billet. Heating the binder-free billet to the second temperature to densify the binder-free billet may further include applying a pressure, for example, greater than or equal to about 136.79 MPa (i.e., about 10 tons per square inch) to less than or equal to about 820.76 MPa (i.e., about 60 tons per square inch). The densified billet may be heated to a third temperature greater than or equal to about 650° C. to less than or equal to about 900° C. to sinter the densified billet and form the workable graphite-containing brass alloy billet.

In one aspect, the brass powder may be produced by water atomization.

In one aspect, the workable graphite-containing brass alloy may include greater than or equal to about 55 wt. % to less than or equal to about 65 wt. % copper; greater than or equal to about 0.05 wt. % to less than or equal to about 2 wt. % of graphite; greater than or equal to about 0 wt. % to less than or equal to about 2.0 wt. % of tin; greater than or equal to about 0 wt. % to less than or equal to about 2.0 wt. % of manganese; greater than or equal to about 0 wt. % to less than or equal to about 2.0 wt. % of silicon; greater than or equal to about 0 wt. % to less than or equal to about 2.0 wt. % of aluminum; greater than or equal to about 0 wt. % to less than or equal to about 2.0 wt. % of iron; greater than or equal to about 0 wt. % to less than or equal to about 2.0 wt. % of nickel; greater than or equal to about 0 wt. % to less than or equal to about 0.15 wt. % of arsenic; greater than or equal to about 0 wt. % to less than or equal to about 0.15 wt. % of antimony; greater than or equal to about 0 wt. % to less than or equal to about 0.5 wt. % of phosphorus; less than or equal to about 0.25 wt. % lead; and a balance of zinc.

In one aspect, the workable graphite-containing brass alloy may be substantially free of one or more of bismuth, chromium, titanium, iron, and tin.

In one aspect, the one or more binders may be selected from hydrocarbons and polyethers.

In one aspect, prior to heating the binder-free billet to the second temperature, the binder-free billet is heated to a third temperature greater than or equal to about 700° C. to less than or equal to about 800° C. to remove oxides.

In various other aspects, the present disclosure provides a yellow-brass billet alloy comprising greater than or equal to about 55 wt. % to less than or to about 65 wt. % of copper; greater than or equal to about 0.05 wt. % to less than or equal to about 2.0 wt. % of graphite; greater than or equal to about 37 wt. % to less than or equal to about 40.5 wt. % of zinc; and less than or equal to about 0.25 wt. % lead.

In one aspect, the yellow-brass billet alloy may include a beta phase that is substantially surrounded by an alpha phase.

In one aspect, the yellow-brass billet alloy may further include greater than or equal to about 0 wt. % to less than or equal to about 2.0 wt. % of tin; greater than or equal to about 0 wt. % to less than or equal to about 2.0 wt. % of manganese; greater than or equal to about 0 wt. % to less than or equal to about 2.0 wt. % of silicon; greater than or equal to about 0 wt. % to less than or equal to about 2.0 wt. % of aluminum; greater than or equal to about 0 wt. % to less than or equal to about 2.0 wt. % of iron; greater than or equal to about 0 wt. % to less than or equal to about 2.0 wt. % of nickel; greater than or equal to about 0 wt. % to less than or equal to about 0.15 wt. % of arsenic; greater than or equal to about 0 wt. % to less than or equal to about 0.15 wt. % of antimony; and greater than or equal to about 0 wt. % to less than or equal to about 0.8 wt. % of phosphorus.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Figure 2:
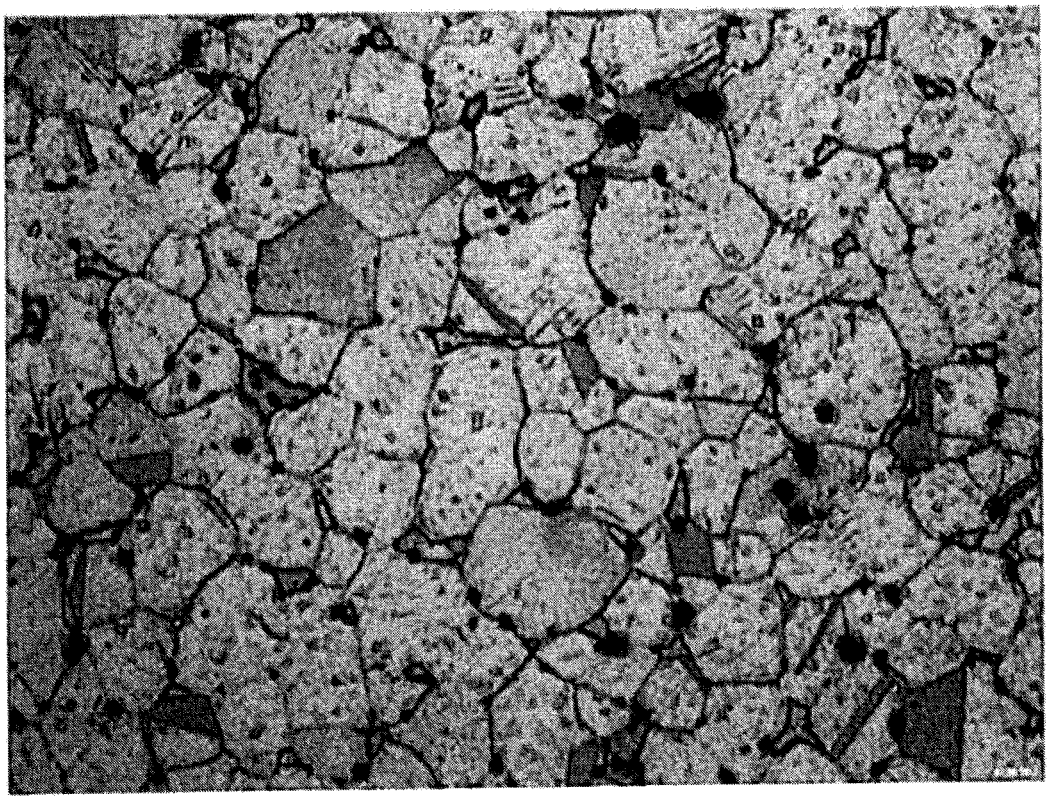

FIG. 1 is a micrograph image at 400× magnification of a graphite-containing brass rod prepared in accordance with various features of the present disclosure; and FIG. 2 is a micrograph image at 400× magnification of a C36000 lead-containing brass rod.

Corresponding reference numerals indicate corresponding parts throughout the several views of the drawings.

DESCRIPTION

Example embodiments will now be described more fully with reference to the accompanying drawings.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The terminology used herein is for the purpose of describing particular example embodiments only and is not intended to be limiting. As used herein, the singular forms "a", "an", and "the" may be intended to include the plural forms as well, unless the context clearly indicates otherwise. The terms "comprises", "comprising", "including", and "having", are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on", "engaged to", "connected to", or "coupled to" another element or layer, it may be directly on, engaged, connected or coupled to the other element or layer, or intervening elements or layers may be present. In contrast, when an element is referred to as being "directly on", "directly engaged to", "directly connected to", or "directly coupled to" another element or layer, there may be no intervening elements or layers present. Other words used to describe the relationship between elements should be interpreted in a like fashion (e.g., "between" versus "directly between", "adjacent" versus "directly adjacent", etc.). As used herein, the term "and/or" includes any and all combinations of one or more of the associated listed items.

Although the terms first, second, third, etc. may be used herein to describe various elements, components, regions, layers, and/or sections, these elements, components, regions, layers, and/or sections should not be limited by these terms. These terms may be only used to distinguish one element, component, region, layer, or section from another region, layer or section. Terms such as "first", "second", and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner", "outer", "beneath", "below", "lower", "above", "upper", and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

Among other features, the present disclosure provides a family of lead-free yellow-brass alloys having improved or enhanced corrosion resistance and machinability, including plentiful chip breakage and lubrication. The lead-free yellow-brass alloy comprises graphite, which is sparingly soluble in copper. For example, at temperatures greater than or equal to about 850° C. to less than or equal to about 950° C. the solubility of carbon in copper is greater than or equal to about 4 ppm to less than or equal to about 6 ppm. The solubility of carbon in brass is expected to fall within a similar range. As such, like lead, graphite collects at the grain boundaries and presents as a discrete constituent. Therefore, graphite-containing brass alloys have similar machinability characteristics as lead-containing brass alloys—for example, relating to cutting tools and chip breaking. Likewise, the two-dimensional hexagonal stacked structure of graphite similarly lubricates the brass during the machining processes, reducing frictional loading and thereby increasing tool life.

Further, such graphite-containing yellow-brass alloys are not only free of the feared health risks, but have greater recyclability compared to their lead-containing counterparts. For example, because graphite has a specific gravity of about 2.2 and brass has a specific gravity of about 8.5, graphite will easily float to a surface of molten brass becoming entrained in a dross. As such, the graphite is easily separable from the brass without contamination. Further, when lead, bismuth, and/or silicon is absent, the graphite-containing yellow-brass do not need to be segregated from other brass chips during the recycling process.

Though improving recyclability, the density difference between lead and graphite may prohibit the use of conventional ingot metallurgy manufacturing processes. A method for producing a graphite-containing workable brass alloy billet that comprises copper, zinc, and graphite and that is substantially lead free (i.e., less than 0.25 wt. %) is provided.

Composition

In various aspects, the graphite-containing workable brass alloy billet may comprise greater than or equal to about 55 wt. % to less than or equal to about 65 wt. % of copper, greater than or equal to about 57 wt. % to less than or equal to about 65 wt. % of copper; and in certain aspects, optionally about 62.5 wt. % of copper; greater than or equal to about 0.05 wt. % to less than or equal to about 2.0 wt. % of graphite; less than 0.25 wt. % of lead; and a remainder of zinc. In various instances, the graphite-containing workable brass alloy billet may further comprise greater than or equal to about 0 wt. % to less than or equal to about 2.0 wt. % of tin; greater than or equal to about 0 wt. % to less than or equal to about 4.0 wt. % of manganese; greater than or equal to about 0 wt. % to less than or equal to about 4.0 wt. % of silicon; greater than or equal to about 0 wt. % to less than or equal to about 2.0 wt. % of aluminum; greater than or equal to about 0 wt. % to less than or equal to about 2.0 wt. % of iron; and greater than or equal to about 0 wt. % to less than or equal to about 2.0 wt. % of nickel.

In various instances, the graphite-containing workable brass alloy billets may also further comprise one or more inhibitors. For example, the graphite-containing workable brass alloy billets may comprise greater than or equal to about 0.02 wt. % to less than or equal to about 0.8 wt. % of one or more inhibitors, and in certain aspects, optionally greater than or equal to about 0.02 wt. % to less than or equal to about 0.2 wt. % of one or more inhibitors. The one or more inhibitors may be selected from the group consisting of: arsenic, antimony, phosphorus, and combinations thereof. For example, the graphite-containing workable brass alloy billets may comprise greater than or equal to about 0 wt. % to less than or equal to about 0.15 wt. % of arsenic; greater than or equal to about 0 wt. % to less than or equal to about 0.15 wt. % of antimony; and/or greater than or equal to about 0 wt. % to less than or equal to about 0.8 wt. %, optionally greater than or equal to about 0 wt. % to less than or equal to about 0.5 wt. %, and in certain aspects, optionally greater than or equal to about 0 wt. % to less than or equal to about 0.2 wt. %, of phosphorus.

In summary:

| | Percent by Weight | |
|---|---|---|
| Element | Minimum | Maximum |
| Cu | 55 | 65 |
| Pb | 0 | 0.25 |
| C | 0.05 | 2.0 |
| Sn | 0 | 2.0 |
| Mn | 0 | 4.0 |
| Si | 0 | 4.0 |
| Al | 0 | 2.0 |
| Fe | 0 | 2.0 |
| Ni | 0 | 2.0 |
| As | 0 | 0.15 |
| Sb | 0 | 0.15 |
| P | 0 | 0.5 |
| Zinc | | remainder |

Further, the brass-powder mixture before compacting and the compacted brass alloy billet (i.e., the initial billet) before binder removal will contain binder in addition to the above metallic and graphitic components. In various aspects, powders of different alloys can be blended together to achieve desired results. The compositions (e.g., the powder mixture, the compacts, and the sintered billets) are substantially free of lead. Some compositions may also be substantially free of one or more of bismuth, chromium, titanium, iron, and/or tin. For example, these aspects can be combined, so that compositions are created that contain no lead and are also substantially free of chromium, titanium, iron, and/or tin. The term "free of" is understood to allow for trace amounts of the elements that might be present as impurities and not intentionally added. The amount of impurities may be less than or equal to about 0.3 wt. %, and in certain aspects, optionally less than or equal to about 0.01 wt. %.

Method

In various aspects, the powder metallurgy process comprises: (1) forming a brass powder; (2) forming a brass-powder mixture comprising the brass powder, graphite, and one or more binders; (3) compacting the brass-powder mixture and forming a compacted brass alloy billet; and (4) submitting the compacted brass alloy billet to one or more heat treatment steps to form a graphite-containing workable brass alloy billet. In various aspects, the method may further include reducing the brass powder prior to mixing the brass powder with the graphite and/or the one or more binders to form the brass-powder mixture.

Forming the Brass Powder—Atomization

In various aspects, the brass powder may be formed from a solid alloy using grinding, machining, or other similar processes. In various other aspects, the brass powder may be formed from a molten brass produced on site or purchased commercially using one or more atomization processes. Atomization generally refers to the change of molten metal into a spray of droplets that solidify into powders. There exists a variety of atomization processes. For example, in certain instances, a high velocity gas stream (e.g., air or inert gas) can be used to atomize the molten metal. In such instances, the gas stream flows through an expansion nozzle that syphons and aspirates the molten metal and sprays the metal into a container where the droplets solidify into a powder form.

In other atomization processes, the molten metal flows (via gravity) through a nozzle and is atomized by air jets. Metal powders resulting from such air-jet processes are spherical, which tend to pack together during subsequent packing, tamping, and sintering steps. In still other atomization processes, a high velocity water stream may be used in place of the air jets. A particular advantage of water atomization is the production of non-spherical shapes. In other atomization processes, the molten metal may be poured onto a rapidly rotating disk that sprays the metal by centrifugal force in all directions to form the brass powder.

Optional: Removing or Reducing Oxides in the Brass Powder

In various aspects, the method may further include reducing the brass powder prior to mixing the brass powder with the graphite and/or the one or more binders to form the brass-powder mixture. For example, in certain aspects, the brass powder may be reduced prior to the formation of the brass-powder mixture. More particularly, the brass powder may be heated to a temperature greater than or equal to about 650° C. to less than or equal to about 900° C., greater than or equal to about 675° C. to less than or equal to about 850° C. and in certain aspects, optionally greater than or equal to about 675° C. to less than or equal to about 825° C., in a reducing atmosphere comprising, for example, hydrogen to remove or reduce oxides. In various instances, the brass powder may be heated to the reducing temperature for greater than or equal to about 15 minutes. In certain other aspects, the brass powder may be mixed with one or more acid solutions comprising greater than or equal to about 0.5 wt. % to less than or equal to about 20 wt. % of one or more of sulfuric acid, hydrochloric acid, nitric acid, and phosphoric acid. In various instances, the brass powder may be mixed with the one or more acid solutions for greater than or equal to about 30 seconds. Following the acid wash and prior to introduction into the brass-powder mixture, the brass powder may be rinsed with water until the pH for the solution exceeds 6.5.

Brass-Powder Mixture

In various aspects, the brass-powder mixture comprises the atomized (and reduced) powder, graphite, and one or more binders. For example, the mixture may comprise greater than or equal to about 0.1 wt. % to less than or equal to about 2.0 wt. % of graphite; greater than or equal to about 0.01 wt. % to less than or equal to about 1 wt. %, greater than or equal to about 0.05 wt. % to less than or equal to about 0.5 wt. %, and in certain aspects, optionally greater than or equal to about 0.03 wt. % to less than or equal to about 0.4 wt. % of the binder; and a balance of the brass powder. In certain aspects, the brass-powder mixture may further comprise one or more additional metal powders. For example, the brass-powder mixture may further comprise greater than or equal to about 0.05 wt. % to less than or equal to about 2.0 wt. % of aluminum and/or greater than or equal to about 0.05 wt. % to less than or equal to about 2.0 wt. % of magnesium.

Graphite. The graphite comprises greater than or equal to about 90 wt. %, greater than or equal to about 99 wt. %, greater than or equal to about 99.9 wt. %, and in certain aspects, optionally greater than or equal to about 99.99 wt. %, of pure carbon. The graphite may have an irregular morphology (e.g., non-spherical) and average particle sizes ranging from greater than or equal to about 3 μm to less than or equal to about 100 μm. For example, in certain aspects, the graphite may have an average particle size of about 9 μm.

Binder. The one or more binders are organic materials that hold the graphite to the metal particles and, in various aspects, counteract the tendency of the comparatively low density graphite to segregate or settle out of the brass-powder mixture. The one or more binders may be selected from the group consisting of: alkanes ($C_nH_{2n+2}$, where n≥10), squalene, mineral spirits, kerosene, isoparaffinic fluids, and polyethers. In various aspects, the one or more binders may have a melting point that is lower than or equal to about 10° C. For example, polyethylene glycol (PEG) having a molecular weight of about 300 M may have improved results compared to polyethylene glycol (PEG) having a molecular weight of about 600 M and a comparatively higher melting point.

In various aspects, the polyethers may include polyalkylene oxides and/or other alkylene oxide polymers and copolymers, such as alcohol ethoxylates and propoxylates. In certain instances, the polyethers may also include polyethylene glycol (PEG), polyethylene oxide, and/or ethylene oxide/propylene oxide block copolymers. In various aspects, the isoparaffinic fluids may be pure hydrocarbons available under the Isopar™ designation from ExxonMobil. Such isoparaffinic fluids are petroleum distillates treated to reduce or eliminate impurities, including aromatics, unsaturated olefins, and reactive polar compounds. The isoparaffinic fluids may have a distillation range (which corresponds with the boiling point of hydrocarbons) that is greater than or equal to about 99° C. to less than or equal to about 313° C. and an aromatic content that is less than or equal to about 0.1 wt. %, less than or equal to about 0.02 wt. %, and in certain aspects, optionally less than or equal to about 0.01 wt. %. For example, in one embodiment, the isoparaffinic fluid may have a distillation range that is greater than or equal to about 219° C. to less than or equal to about 258° C.; an aromatic content of about 0.013 wt. %; and an aniline point of about 85. In various aspects, when compared to n-butyl acetate having an evaporation rate of 100, the isoparaffinic fluids may have an evaporation rate that is less than about 1.

Compaction

The brass-powder mixture—including the brass powder, the graphite, and binders—may be subjected to one or more compaction steps to form a compacted brass alloy billet. For example, compacting pressures may be applied to cause the metal particles to come together, eliminating voids between the particles and creating a higher density billet. The compressed brass alloy billet (i.e., the initial billet) may have a density that is at least 60% of a theoretical density. The theoretical density is the density of a solid-metal billet having no voids and is a function of the percent composition of each element and the respective densities of the alloying components.

The compaction process can take a number of forms, such as performing a plurality of consolidation cycles. In various aspects, the compacting process may be uniaxial or isostatic. For example, the compacted brass alloy billet may be formed using a uniaxial compression or pressing compaction process. Such compaction processes include the use of multiple opposing punches (e.g., opposing upper and lower punches) that compress the powders contained in a die. In particular, applying uniaxial pressure to a compacting cylinder may create friction on a die wall so to shape a density gradient along the direction of action forming. In certain aspects, compactions may have a diameter of about 254 mm (i.e., about 10 inches) and a minimum length of about 25.4 mm (i.e., about 1 inch). Multiple consolidation cycles may occur before ejecting the compactions. In certain aspects, the compactions may be placed inside of a hollow shell having a minimum length of about 914.4 mm (i.e., about 36 inches) and subsequently extruded. Optionally, in certain other aspects, the multiple compactions can be sintered under pressure to a minimum length of 914.4 mm (i.e., about 36 inches). During extrusion, the individual compacts may be extruded back to back without impacting the quality of the final product.

In various other aspects, the compacted brass alloy billet may be formed using an isostatic compression or pressing compaction process. Such compaction processes include the use of flexible molds and hydraulic pressure. For example, the brass-powder mixture may be placed in a flexible mold and hydraulic pressure may be applied against the mold to compact the powders. Water or oil may be used to create the hydraulic pressure. Unlike uniaxial compression or pressing compaction processes, isostatic pressuring applies force evenly in all directions.

In various instances, cold isostatic pressing may be used. Cold isostatic pressing occurs at comparatively low temperatures—for example, at room temperature. In such instances, the molds may be oversized to accommodate shrinkage. In various other instances, hot isostatic pressing may be used. However, in certain instances, cold isostatic pressing may be preferred because its tooling expenses are smaller compared to hot isostatic pressing. Hot isostatic pressing includes the used of elevated temperatures and pressure and one or more gases, such as argon or helium, for the compression medium.

In various aspects, the compacted or pressed brass alloy billet, also known as a green-stage compact, may be in the form of a cylinder having a diameter greater than or equal to about 127 mm (i.e., about 5 inches) to less than or equal to about 381 mm (i.e., about 15 inches), and in certain instances, optionally greater than or equal to about 254 mm (i.e., about 10 inches) to less than or equal to about 304.8 mm (i.e., about 12 inches). For example, in one embodiment, the pressed brass alloy billet may have a diameter of about 304.8 mm (i.e., about 12 inches) and a length of about 2,133.6 mm (i.e., about 84 inches). In each instance, the pressed brass alloy billet has sufficient green strength so to allow for handling of the billet prior to subsequent thermo-mechanical processing (e.g., sintering and hot extrusion) without cracking. Green strength is primarily affected by the morphology of the powder and the amount of force applied during the compaction process. The morphology of the powder is dependent on the powder formation process (e.g., water atomization); and in various aspects, a compression force ranging from greater than or equal to about 136.79 MPa (i.e., about 10 tons per square inch) to less than or equal to about 478.78 MPa (i.e., about 35 tons per square inch) may be applied to the brass-powder mixture to produce a compacted brass alloy billet having a minimum green strength of about 2,735.86 MPa (i.e., about 200 pounds per square inch).

Heat Treatments

The compacted brass alloy billet may be subjected to one or more heat treating steps. For example, a first heat treatment step may be used to remove the one or more binders; an optional second heat treatment may be used to optionally reduce the binder-free compacted billet; an optional third heat treatment that may include the application of pressure may be used to densify the binder-free compacted billet; and a fourth heat treatment may be used to sinter the binder-free or modified compacted brass alloy billet so to form a workable brass alloy billet. The workable brass alloy billet may be further extruded to create a brass rod that can be further machined and/or hot or cold worked to produce desired brass pieces—for example, valves.

First Heat Treatment. In various aspects, the compacted brass alloy billet is heated to a first elevated or debinder temperature to remove the one or more binders. More specifically, the one or more binders can be removed from the compacted brass alloy billet when conditions are such that the one or more binders are volatized (e.g., evaporated) without undergoing significant pyrolysis. Generally, lower temperatures favor volatilization, while higher temperatures lead to pyrolysis. Moreover, because the one or more binders are organic materials, evaporation and pyrolysis occur at comparatively low temperatures.

To remove the one or more binders by evaporation or volatilization, the compacted brass alloy billet is heated to a first temperature that is close to or above the boiling point of the one or more organic materials. For example, in various aspects, heating the brass alloy billet to remove or reduce the quantity of the one or more binders includes plateau heating the compact to the first temperature and holding that temperature for a first time period. In certain instances, the first time period may be greater than or equal to about 60 seconds per inch (i.e., about 25.4 mm) of billet thickness. In various other aspects, heating the brass alloy billet to remove or reduce the quantity of the one or more binders includes ramp heating the compact to the first elevated temperature and continuing therefrom to the second, third, and/or fourth elevated temperatures.

In each instance, the compacted brass alloy billet may be heated to a first temperature greater than or equal to about 100° C. to less than or equal to about 400° C., greater than or equal to about 100° C. to less than or equal to about 300° C., greater than or to about 200° C. to less than or equal to about 400° C., greater than or to about 200° C. to less than or equal to about 300° C., and in certain aspects, optionally greater than or equal to about 205° C. to less than or equal to about 300° C. In certain aspects, the binder removal reaction may be carried out in an inert environment comprising, for example, nitrogen. In certain other aspects, the binder removal reaction may be carried out in an oxidizing environment comprising, for example, air.

Optional: Second Heat Treatment. Following removal of the one or more binders, the binder-free or modified compacted brass alloy billet may be subjected to an optional second heat treatment. The second heat treatment may remove or reduce oxides remaining in the modified compacted brass alloy billet that may have been formed during the atomization or compacting processes. The optional second heat treatment includes heating the modified compacted brass alloy billet to a second elevated or reducing temperature. The second elevated or reducing temperature may be greater than the debinder temperature. Oxide removal is accomplished by a reducing atmosphere (comprising, for example, hydrogen), a reducing agent (such as, carbon), or by liquid phase sintering promoted by aluminum and/or magnesium at the second elevated temperature. For example, to remove the undesirable oxides, the modified compact brass alloy billet may be heated to a second temperature greater than or equal to about 700° C. to less than or equal to about 800° C. in a reducing environment comprising, for example, a minimum of about 5% hydrogen gas and a remainder of nitrogen. In certain instances, the modified compacted brass alloy billet may be heated to the second elevated temperature for a second time period. The second time period may be greater than or equal to about 60 seconds per inch (i.e., about 25.4 mm) of billet thickness.

Optional Third Heat Treatment. Following removal of the one or more binders and/or reduction, the modified compacted brass alloy billet may be subjected to an optional third heat treatment. In various aspects, the optional third heat treatment step includes heating the modified compacted brass alloy billet and, in certain aspects, applying pressure (e.g., a compression force) to the modified compacted brass alloy billet while the modified compacted brass alloy billet is still hot. The third heat treatment may further densify the modified compacted brass alloy billet. For example, so as to form, a densified modified compacted brass alloy billet having a density that is at least 93%, optionally at least 96%, and in certain aspects, optionally at least 97%, of a theoretical density.

The optional third heat treatment includes heating the modified compacted brass alloy billet to a third elevated or densifying temperature. The third elevated or densifying temperature may be greater than the debinding temperature. The third heat treatment may be applied, in certain aspects, using a hot upsetting process. For example, to densify the modified compacted brass alloy billet, the modified compacted brass alloy billet may be heated to a third elevated temperature greater than or equal to about 480° C. to less than or equal to about 750° C., and in certain aspects, optionally greater than or equal to about 540° C. to less than or equal to about 700° C. While the modified compacted brass alloy billet is heated to the third temperature, a compression force greater than or equal to 41.04 MPa (i.e., about 3 tons per square inch) to less than or equal to 820.76 MPa (i.e., about 60 tons per square inch), and in certain aspects, optionally greater than or equal to 136.79 MPa (i.e., about 10 tons per square inch) to less than or equal to 820.76 MPa (i.e., 60 tons per square inch), may also be applied to the modified compacted brass alloy billet In certain instances, the modified compacted brass alloy billet may be heated to the third elevated temperature for a third time period. The third time period may be greater than or equal to about 60 seconds per inch (i.e., about 25.4 mm) of billet thickness.

Fourth Heat Treatment. Following one or more of the first, second, and third heat treatments, the modified compacted brass alloy billet may be subjected to a fourth elevated or sintering temperature to sinter the billet. The fourth elevated temperature should not approach or exceed the melting points of the billet metals, as such may cause the billet to undesirably distort under its own weight. In various aspects, the modified compacted brass alloy billet may be heated to a fourth temperature greater than or equal to about 650° C. to less than or equal to about 900° C., greater than or equal to about 650° C. to less than or equal to about 875° C., greater than or equal to about 760° C. to less than or equal to about 875° C. and in certain aspects, optionally greater than or equal to about 810° C. to less than or equal to about 875° C., to form a workable brass alloy billet. In certain instances, the modified compacted brass alloy billet may be heated to the fourth elevated temperature for a fourth time period. The fourth time period may be greater than or equal to about 60 seconds per inch (i.e., about 25.4 mm) of billet thickness.

Example Heat Treatment Process. For example, in various aspects, the compacted brass alloy billet may be heated to a debinder or first temperature greater than or equal to about 220° C. for a first time period to remove the binder. After sufficient removal of the binder, the modified compacted brass alloy billet may be heated to a second temperature greater than or equal to about 700° C. to less than or equal to about 860° C. in a reducing environment comprising 5% hydrogen and a remainder of nitrogen for a second time period to reduce or remove oxides. After one of the debinding and reducing, the modified compacted brass alloy billet may be heated while pressure is also applied to a densification or third temperature greater than or equal to about 540° C. to less than or equal to about 700° C. for a third time period to densify the compacted brass alloy billet. Following sufficient removal or reduction of oxides and/or densification of the compacted brass alloy billet, the densified or modified compacted brass alloy billet may be heated to a sintering of fourth temperature greater than or equal to about 675° C. to less than or equal to about 850° C. to promote solid-state particle bonding and formation of a workable brass alloy billet.

Additional Optional Processing Steps. In various aspects, after sintering, the workable brass alloy billet may be directly hot extruded so to eliminate the need for a subsequent reheating process step. In various other aspects, following sintering, the workable brass alloy billet may be cooled and stored for later processing. In various aspects, extrusions of the graphite-containing powder metal billets may be performed using the same or similar conditions used to extrude lead-containing brass alloys. For example, the workable brass alloy billet can be extruded into a rod from which usable parts may be further formed, typically by machining, using existing equipment at billet temperatures and speeds common to other brass alloys.

Properties of Graphite-Containing Workable Brass Alloy Rods

The above described atomization and powder compaction processes create microstructures that are not achievable with traditional ingot metallurgical processes. More specifically, the grain size of the graphite-containing powder metal rods may be smaller than comparable lead-containing rods having the same copper content. Further, though lead-containing rods have smaller zinc contents, the beta phase in the graphite-containing brass rods may be more widely dispersed and unconnected. For example, compare FIGS. 1 and 2. FIG. 1 is a micrograph image at 400× magnification of a graphite-containing brass rod prepared in accordance with various features of the present disclosure, while FIG. 2 is a micrograph image also at 400× magnification of a C36000 lead-containing brass rod. Both examples exhibit uniform dispersion of a chip breaker.

Mechanical Properties of Graphite-Containing Workable Brass Alloy Rods

As further detailed below, the graphite-containing workable brass alloy rods prepared in accordance with various aspects of the present disclosure satisfy minimum industry standards—namely, the ASTM B-16 "Standard Specification for Free-Cutting Brass Rod, Bar, and Shapes for Use in Screw Machines"—as well as other industry corrosion resistance and machinability standards. For example, graphite-containing workable brass alloy rods prepared in accordance with various aspects of the present disclosure may demonstrate the following:

| Example Rod | Ultimate Tensile Strength (ksi) | Yield Strength (0.5% Extension Under Load) (ksi) | Elongation (%) |
|---|---|---|---|
| ASTM B-16 | 55 | 25 | 10 |
| C36000 | 59 | 41 | 26 |
| Graphite Brass: 63 wt. % copper 0.7 wt. % graphite remainder of zinc | 56 | 40 | 23 |

-continued

| Example Rod | Ultimate Tensile Strength (ksi) | Yield Strength (0.5% Extension Under Load) (ksi) | Elongation (%) |
|---|---|---|---|
| Graphite Brass: 62 wt. % copper 1.2 wt. % graphite remainder of zinc | 55 | 35 | 17 |

Notably, as illustrated by the above examples, graphite-containing free machining brass alloy rods prepared in accordance with various aspects of the present disclosure may demonstrate both high yield strength (ksi) and elongation (%). For example, graphite-containing free machining workable brass alloy rods prepared in accordance with various aspects of the present disclosure may have a yield strength (ksi) greater than or equal to about 30 ksi, and in certain aspects, optionally greater than or equal to about 40 ksi; and elongation (%) greater than or greater than or equal to about 15%, and in certain aspects, optionally greater than or equal to about 30%. Graphite-containing free machining workable brass alloy rods prepared in accordance with various aspects of the present disclosure may achieve this high yield strength (ksi) and elongation (%) combination while also having less than or equal to about 65 wt. % of copper.

Stress Corrosion Cracking Resistance. The ASTM B154 ("Standard Test Method for Mercurous Nitrate Test for Copper Alloys) is a common specification marker for testing copper alloys for resistance to stress corrosion cracking. More specifically, if a sample is submerged in a solution of mercurous nitrate in accordance with the ASTM B154 standards and no cracking is subsequently observed, the sample is considered resistant to stress corrosion cracking. The specific microstructure of the graphite-containing workable brass alloy rods prepared in accordance with various aspects of the present disclosure improves the stress corrosion cracking resistance of the brass rod. For example, the graphite-containing workable brass alloy billet may have significantly more—for example, at least twice as many—nucleation locations available during recrystallization phases of hot-working processes therefore resulting in a significantly smaller grain size, for example as seen in FIG. 1. Smaller grain sizes inhibit stress corrosion cracking. As such, by hot extruding the brass-powder mixture an alloy can be produced that is resistant to stress corrosion cracking without requiring any post cold work thermal processing.

Dezincification Resistance. The alpha phase in yellow brass can be made dezincification resistant through use of one or more inhibitors, such as arsenic, antimony, and/or phosphorus. However, there is no known method to inhibit dezincification in the beta phase of yellow brass. As such, in order to be dezincification resistant, a yellow brass need be either a completely alpha phase alloy or, alternatively, any beta phase present must be dispersed throughout the brass so to not interconnect at any significant level. To determine dezincification resistance, the industry commonly relies on the requirements of NSF-14 "Plastics Piping System Components and Related Materials" and brass samples are tested in accordance with ISO 6509 "Corrosion of Metal and Alloys—Determination of Dezincification Resistance of Brass." To be considered dezincification resistant, the test sample's maximum depth of dezincification must not exceed 200 microns.

Commonly, there are two traditional methods to reduce the amount of interconnected beta phase in yellow brass: first, reduce the amount of zinc to a low enough level that minimum beta phase brass alloy is formed; and second, perform a post hot-working heat treatment process to minimize or more evenly disperse the beta phase within the brass alloy. Using these conventional processes, it was difficult—and in certain instances, impossible—to form dezincification resistant yellow brass alloys containing more than about 35 wt. % zinc without a post hot-working heat treatment. The graphite-containing workable brass alloy rod prepared in accordance with various aspects of the present disclosure comprises a brass powder with up to 38% zinc and does not require a post hot-working heat treatment.

More specifically, because the alpha phase is inhibited with one or more inhibitors—such as, antimony, arsenic, phosphorus, or a combination thereof—the alpha phase is resistant to dezincification; and as illustrated in FIG. 1, any beta phase present within the rod is surrounded by alpha phase. As such, the graphite-containing workable brass alloy rod prepared in accordance with various aspects of the present disclosure comprises less than or equal to about 38 wt. % of zinc and satisfies the dezincification maximum depth requirement of NSF-14 without requiring a post hot-working heat treatment or slow cooling process.

Recycling of Brass Alloys

Graphite-containing workable brass alloy rods prepared in accordance with various aspects of the present disclosure are primarily used as feedstock for machining operations. In such instances, between 60% and 70% of the rod material is machining loss in the form of brass chips. In various aspects, recycling the excess involves drying the machined chips as needed and directly pouring the chips into a bag for cold isostatic pressing or uniaxial pressing. In certain aspects, prior to pressing, the chips may be mixed with one or more acid solutions comprising greater than or equal to about 0.5 wt. % to less than or equal to about 20 wt. % of one or more of sulfuric acid, hydrochloric acid, nitric acid, and phosphoric acid for a time period greater than or equal to about 30 seconds and, subsequently, rinsed with water until the pH for the solution exceeds 6.5. After pressing (and in certain aspects, an acid wash), and in certain instance, optional hot-work densification (e.g., hot upsetting), the compacted chips are exposed to a sintering heat treatment process and then hot extruded and/or cold drawn as normal. The recycled brass alloy may have the same composition of the originally machined graphite-containing workable brass alloy rod. Advantageously, recycling the alloy does not require a de-binder step, because the chips themselves contain no binder.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A method of producing a workable graphite-containing brass alloy billet having less than 0.25 wt. % lead, the method comprising:

forming a brass powder comprising copper and zinc;

mixing the brass powder with graphite and one or more binders, wherein the one or more binders are selected from the group consisting of: squalene, mineral spirits, kerosene, isoparaffinic fluids, and polyethers;

compacting the brass-powder mixture to form an initial billet, the initial billet having a diameter greater than or equal to 127 mm to less than or equal to 381 mm;

heating the initial billet to a first elevated temperature range and holding the first elevated temperature range for a first time period to remove the one or more binders wherein the first time period is greater than or equal to 60 seconds per 25.4 mm of billet diameter;

heating the binder-free billet to a second elevated temperature range that is higher than the first elevated temperature range to densify the binder-free billet; and heating the densified billet to a third elevated temperature range that is higher than the first elevated temperature range and different from the second elevated temperature range to sinter the densified billet and form the workable graphite-containing brass alloy billet wherein the first elevated temperature range is greater than or equal to 200 degrees C. to less than or equal to 300 degrees C.; the second elevated temperature range is greater than or equal to 480 degrees C. to less than or equal to 750 degrees C.; and the third elevated temperature range is greater than or equal to 650 degrees C. to less than or equal to 900 degrees C.

2. The method of claim 1, wherein the method further includes, prior to mixing of the brass powder with the graphite and the one or more binders, heating the brass powder to a reducing temperature range greater than or equal to 650° C. to less than or equal to 900° C. in a reducing atmosphere.

3. The method of claim 1, wherein the method further includes, prior to the mixing of the brass powder with the graphite and the one or more binders, deoxidizing the brass powder by mixing the brass powder with an acid solution comprising greater than or equal to 0.5 wt. % to less than or equal to 20 wt. % of one or more acids and rinsing the brass powder with water until the pH of the brass powder exceeds 6.5.

4. The method of claim 3, wherein the one or more acids are selected from sulfuric acid, hydrochloric acid, nitric acid, and phosphoric acid.

5. The method of claim 1, wherein the brass powder is formed by water atomization.

6. The method of claim 1, wherein the initial billet comprises a cylinder a length greater than or equal to 25.4 mm.

7. The method of claim 1, wherein the initial billet comprises:

greater than or equal to 55 wt. % to less than or equal to 65 wt. % copper;

greater than or equal to 0.1 wt. % to less than or equal to 2.0 wt. % graphite; and, a balance of zinc.

8. The method of claim 1, wherein the initial billet comprises greater than or equal to 0.02 wt. % to less than or equal to 0.8 wt. % of one or more inhibitors, wherein the one or more inhibitors are selected from the group consisting of arsenic, phosphorus, antimony, and combinations thereof.

9. The method of claim 1, wherein compacting comprises one of cold isostatic pressing ("CIP") and uniaxial pressing.

10. The method of claim 1, wherein compacting comprises pressing the brass-powder mixture to a minimum density of 60% of a theoretical density.

11. The method of claim 1, wherein heating the binder-free billet to a second elevated temperature range includes applying a pressure while the binder-free billet is at the second elevated temperature range, wherein the applied pressure is greater than or equal to 136.79 MPa to less than or equal to 820.76 MPa.

12. The method of claim 1, wherein the densified billet has a minimum density of 93% of a theoretical density.

13. The method of claim 1, wherein the workable graphite-containing brass alloy billet is free of nickel.

14. The method of claim 1, wherein the workable graphite-containing brass alloy billet comprises less than or equal to about 0.1 wt. % of nickel.

15. A method of producing a workable graphite-containing brass alloy billet having less than 0.25 wt. % lead, the method comprising:

mixing a brass powder comprising copper and zinc with an acid solution comprising one or more of sulfuric acid, hydrochloric acid, nitric acid, and phosphoric acid;

rinsing the brass powder with an aqueous solution until the pH of the brass-powder exceeds 6.5;

mixing the brass powder with greater than or equal to 0.05 wt. % to less than or equal to 2.0 wt. % of a graphite powder and greater than or equal to 0.02 wt. % to less than or equal to 1 wt. % of one or more organic binders to form a brass-powder mixture, wherein the one or more organic binders are selected from the group consisting of: squalene, mineral spirits, kerosene, isoparaffinic fluids, and polyethers;

compacting the brass-powder mixture to form an initial billet, the initial billet having a diameter greater than or equal to 127 mm to less than or equal to 381 mm;

heating the initial billet to a first temperature range and holding the first temperature range for a first time period to remove the binder, wherein the first time period is greater than or equal to 60 seconds per 25.4 mm of billet diameter;

heating the binder-free billet to a second temperature range that is greater than the first temperature range to densify the binder-free billet, wherein heating the binder-free billet to the second temperature range includes applying a pressure greater than or equal to 154 MPa to less than or equal to 926 MPa while the binder-free biller is at the second temperature range; and heating the densified billet to a third temperature range that is greater than the second temperature range to sinter the densified billet and form the workable graphite-containing brass alloy billet wherein the second temperature range is greater than or equal to 480 degrees C. to less than or equal to 750 degrees C.; and wherein the third temperature range is greater than or equal to 650 degrees C. to less than or equal to 900 degrees C.

16. The method of claim 15, wherein the brass powder is produced by water atomization.

17. The method of claim 15, wherein the workable graphite-containing brass alloy billet comprises:

greater than or equal to 55 wt. % to less than or equal to 65 wt. % copper;

greater than or equal to 0.05 wt. % to less than or equal to 2 wt. % of graphite greater than or equal to 0 wt. % to less than or equal to 2.0 wt. % of tin;

greater than or equal to 0 wt. % to less than or equal to 2.0 wt. % of manganese;

greater than or equal to 0 wt. % to less than or equal to 2.0 wt. % of silicon;

greater than or equal to 0 wt. % to less than or equal to 2.0 wt. % of aluminum;

greater than or equal to 0 wt. % to less than or equal to 2.0 wt. % of iron;

greater than or equal to 0 wt. % to less than or equal to 0.15 wt. % of arsenic;

greater than or equal to 0 wt. % to less than or equal to 0.15 wt. % of antimony;

greater than or equal to 0 wt. % to less than or equal to 0.5 wt. % of phosphorus;

less than or equal to 0.25 wt. % lead; and a balance of zinc.

18. The method of claim 15, wherein the workable graphite-containing brass alloy is free of one or more of bismuth, chromium, titanium, iron, and tin.

19. The method of claim 15, wherein prior to heating the binder-free billet to the second temperature range, the binder-free billet is heated to a fourth temperature range greater than or equal to 700° C. to less than or equal to 800° C. to remove oxides.

* * * * *